US008162701B2

(12) United States Patent
Lee et al.

(10) Patent No.: US 8,162,701 B2
(45) Date of Patent: Apr. 24, 2012

(54) SOCKET STRUCTURE AND ELECTRONIC DEVICE HAVING THE SAME

(75) Inventors: Yaw-Tzoung Lee, Taoyuan Hsien (TW); Ko-Kuei Chen, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 12/849,976

(22) Filed: Aug. 4, 2010

(65) Prior Publication Data

US 2011/0034071 A1 Feb. 10, 2011

(30) Foreign Application Priority Data

Aug. 5, 2009 (TW) ..... 98126445 A

(51) Int. Cl.
*H01R 13/514* (2006.01)

(52) U.S. Cl. ..... 439/731

(58) Field of Classification Search ..... 439/731, 439/76.1; 361/736, 752
See application file for complete search history.

(56) References Cited

U.S. PATENT DOCUMENTS 6,086,408 A * 7/2000 Tanigawa ..... 439/419
6,220,872 B1 * 4/2001 Chen ..... 439/76.1
6,309,225 B2 * 10/2001 Kameyama ..... 439/76.1
7,059,915 B1 * 6/2006 Schempp et al. ..... 439/676

* cited by examiner

*Primary Examiner* — Phuong Dinh
(74) *Attorney, Agent, or Firm* — Kirton McConkie; Evan R. Witt

(57) ABSTRACT

A socket structure, which can be applied to an electronic device, is disclosed. The socket structure comprises a socket body and a holder unit. The socket body further comprises two opposite ends to transport power, a first connecting device and a second connecting device; the holder unit further comprises a third connecting device and a fourth connecting device. The first connecting device is engaged with the third connecting device and the second connecting device is engaged with the fourth connecting device so that the socket structure is formed and the socket body can be secured to the electronic device.

18 Claims, 8 Drawing Sheets

SOCKET STRUCTURE AND ELECTRONIC DEVICE HAVING THE SAME

FIELD OF THE INVENTION

The present invention relates to a socket structure, and more particularly to a socket structure to transport electrical power for use with a variety of different electronic devices.

BACKGROUND OF THE INVENTION

In transporting electrical power, sockets are equipped by wide variety of electronic devices. As the use of electronic devices continues to increase, recent trends keep indicating that the products in demand are developed towards safety, flexibility in customization, in addition to mass-production. Sockets as a major component in the electronic device couldn't be any exception to the same.

FIG. 1 is an exploded view schematically showing a conventional socket and electronic device structure. As shown in FIG. 1, there is a gap 142 formed between a first ring 141 extended from a socket body 14 and a second ring 143 extended from the same. An opening 13 is formed when an upper casing 11 and a lower casing 12 are combined into one assembled casing. In fabricating, the opening 13 is configured to accommodate the socket body 14 and insert the assembled casing into the gap 142. Since the assembled casing is clamped by the first ring 141 and the second ring 143 of the socket body 14, the socket body 14 can be integrated with the electronic device 1. It is to be understood that the socket could be placed in support of the assembled casing, and the traditional solution could prevent the socket body 14 from retreating into the assembled casing or escaping from the electronic device 1. Notwithstanding the advantage, the use of sockets as described above presents several challenges.

It is to be understood that sockets within an electronic device in use will frequently receive stresses from the repetition of push and pull by end users. The task the conventional way to ensure this part is made difficult when the socket body 14 is mainly supported by a pretty narrow margin, where is clamped by its rings 141, 143, on the assembled casing adjacent to the opening 13. Besides, the assembled casing in use is expected to be struck by any kind of outside forces, and over time the casing structure will become frail due to the aging of itself. As a result, supports from the assembled casing in securing the socket body 14 to the electronic device 1 remains unreliable. In addition, the socket body 14 in fabricating has to be placed between the two casings 11, 12 which form the opening 13 according to the prior art. This inherent limitation on layout arrangement is troublesome. As a result, compromises and tradeoffs in practical design are often required.

Further, the socket body 14 is normally tailed with and connected to certain electrical circuitry of the electronic device 1. According to the prior art, the connecting points might become loose due to an unstable socket body 14 in assembling. But the socket body 14 is liable to be unstably placed until the completion of the assembly of the two casings 11, 12. While the socket body 14 has been in position, all components in the electronic device will be sealed by the two casings 11, 12 and out of inspection. For ascertaining, the assembled casing thus has to be separated, and the socket body is left unstably again. Accordingly, it makes the assembly work complicated and require additional effort in time and work for fabricating and inspecting. After those, the production quality still remains questionable.

Apparently, several needs emerge from the prior art. It is desirable to provide a socket that can be firmly secured to electronic devices, flexible in layout arrangement, and of simple construction, easily manufactured and inexpensive production.

SUMMARY OF THE INVENTION

It is an object of an embodiment of the present invention to provide a socket structure and an electronic device having such socket structure in which the socket body is secured to the electronic device requiring little concern about the support of the casing which is adjacent to the socket body.

It is another object of an embodiment of the present invention to provide a socket structure and an electronic device having such socket structure in which the socket structure is easily to be set in position in fabricating and the components inside the casing of the electronic device are easily to be inspected in assembly.

It is another object of an embodiment of the present invention to provide a socket structure and an electronic device having such socket structure in which the socket structure has high flexibility to meet customized requirement on the placement arrangement for designing the electronic device.

In accordance with an aspect of the present invention, there is provided a socket structure comprising a socket body and a holder. The socket body has a flange extended outwardly from a lateral wall of one end of the socket body, and two connecting members respectively arranged on the lateral wall between the flange and the other end of the socket body. The holder has two further connecting members, wherein the two connecting members of the holder are engaged with the two connecting members of the socket body.

In accordance with an aspect of the present invention, there is provided an electronic device comprising a casing, an electrical circuit, a socket body and a holder. The socket body has a flange extended outwardly from a lateral wall of one end of the socket body, and two connecting members respectively arranged on the lateral wall between the flange and the other end of the socket body. The holder has two connecting members, wherein the two connecting members of the holder are engaged with the two connecting members of the socket body. The end with the flange on the socket body is configured to be mated with an opening of the holder, and the other end of the socket body is coupled to the electrical circuit. The flange overlaps an inner wall of the casing which is abutting to the opening.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
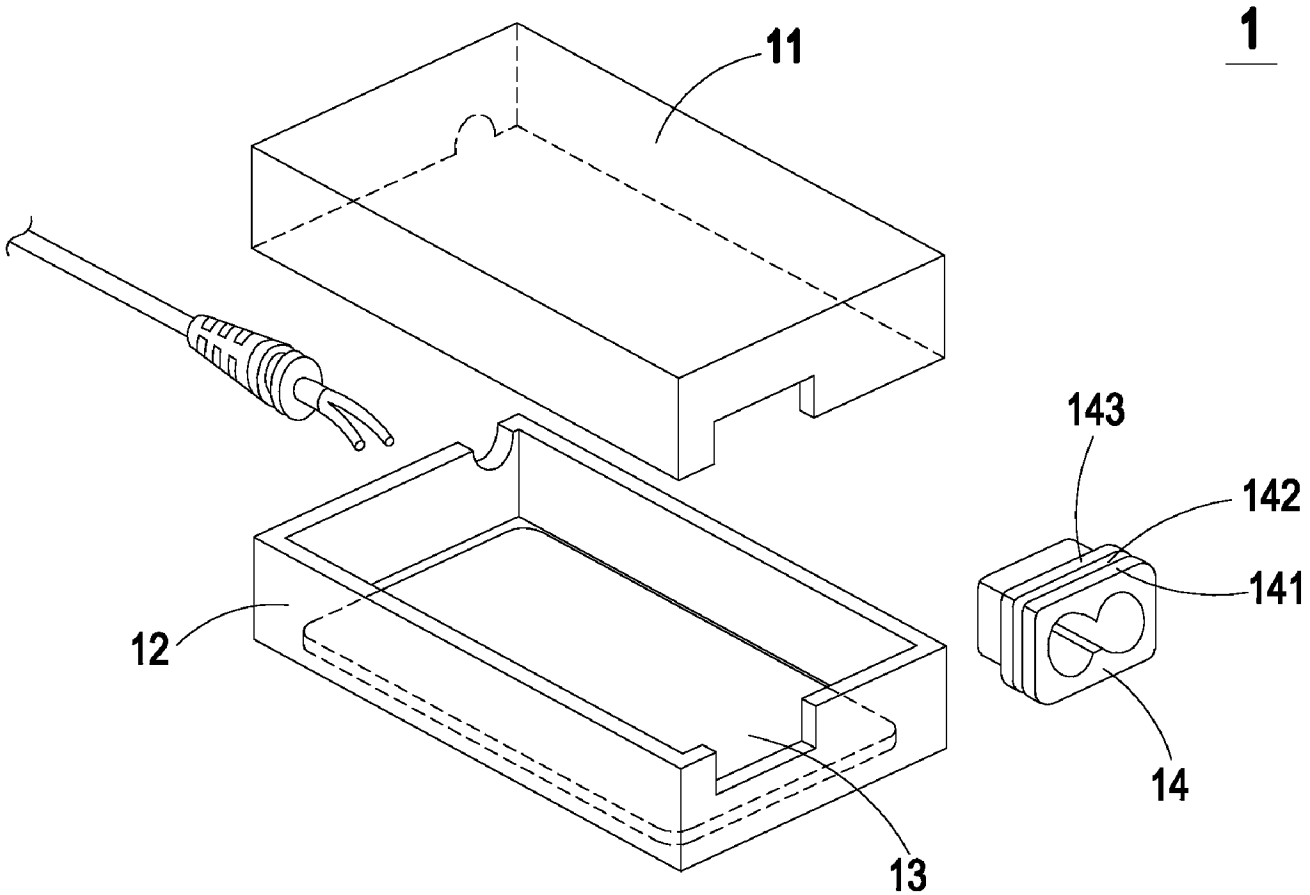
FIG. 1 PRIOR ART
FIG. 1 is an exploded view schematically showing a conventional socket and electronic device structure.
Figure 2B:
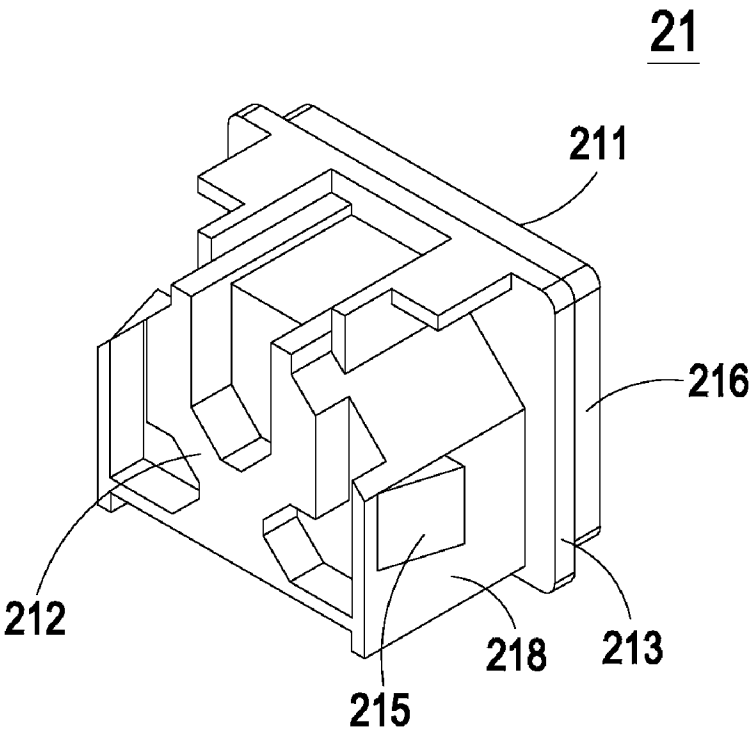
FIG. 2B shows a rear view of a socket body according to one embodiment of the invention.
Figure 2A:
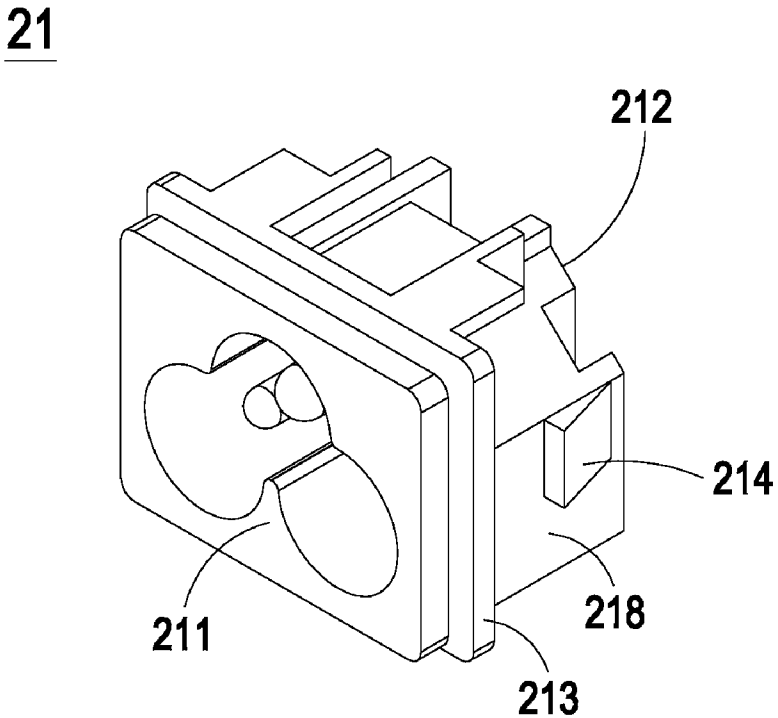
FIG. 2A shows a front view of a socket body according to one embodiment of the invention.

According to one embodiment of the present invention, a socket structure comprises a socket body and a holder unit. The socket body is for transporting power when the holder unit is for securing the socket body to an electronic device. FIGS. 2A and 2B respectively show the front and back views of a socket body according to one embodiment of the invention. As shown in FIG. 2A, the socket body 21 has a first end 211, a second end 212 and a first connecting member 214, wherein a flange 213 extended outwardly from a first lateral wall 218 of the first end 211. As shown in this embodiment, the first end 211 and the second end 212 are two opposite ends of the socket body 21. In some situations, it is possible that the two ends are not necessarily placed to be opposite to each other. Generally, the first end 211 is for the use of receiving an AC input power, and the second end 212 for being coupled to an electrical circuit (not shown) so that the socket body 21 transports the power. The first connecting member 214 and a second connecting member 215 are respectively arranged between the flange 213 and the second end 212 on the socket body 21. As shown in FIG. 2B, a second connecting member 215 disposed on the first lateral wall 218 opposite to the first connecting member 214 is provided.

Figure 3:
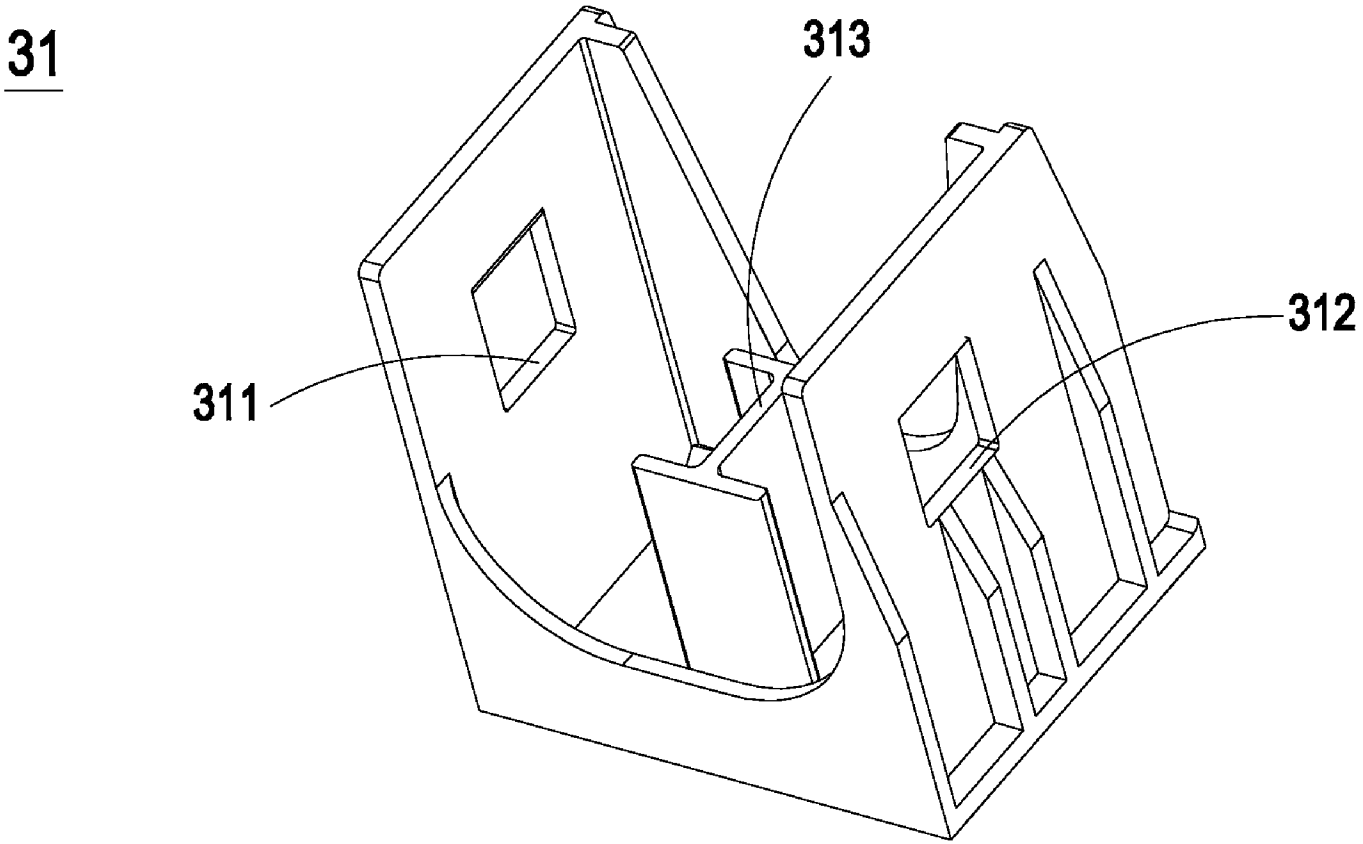
FIG. 3 illustrates a schematic of a holder unit according to one embodiment of the invention.

FIG. 3 illustrates a schematic of a holder unit according to one embodiment of the invention. As shown in FIG. 3, the holder unit 31 has a third connecting member 311 and a forth connecting member 312. In the embodiment described herein, the connecting members of either the socket body 21 or the holder unit 21 are set symmetrically. In some situations, they are also possible to be placed asymmetrically as long as the required engagement described below could be achieved. The holder unit 31 further has a protrusion member 313 disposed on the bottom of the holder unit 31 in order to confine the second end 212 of the socket body 21 as shown in FIG. 3. The protrusion member 313 is capable of improving the safety in use and helping the positioning of the socket body 21 in assembling.

Figure 4A:
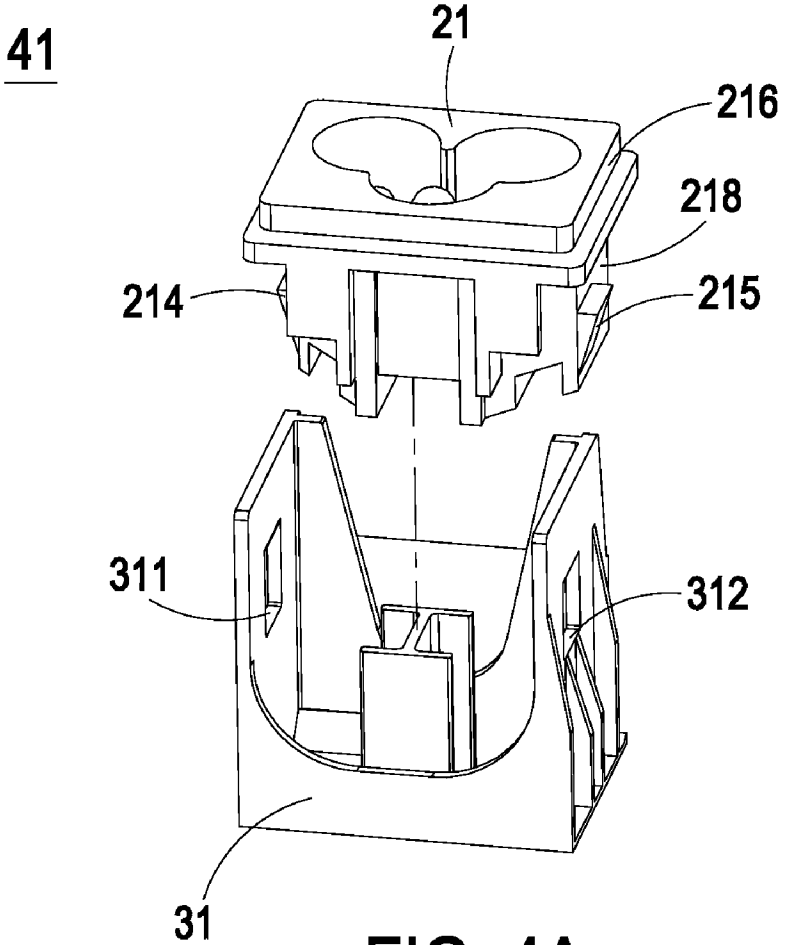
FIG. 4A shows an exploded view of a socket structure according to one embodiment of the invention.
Figure 4B:
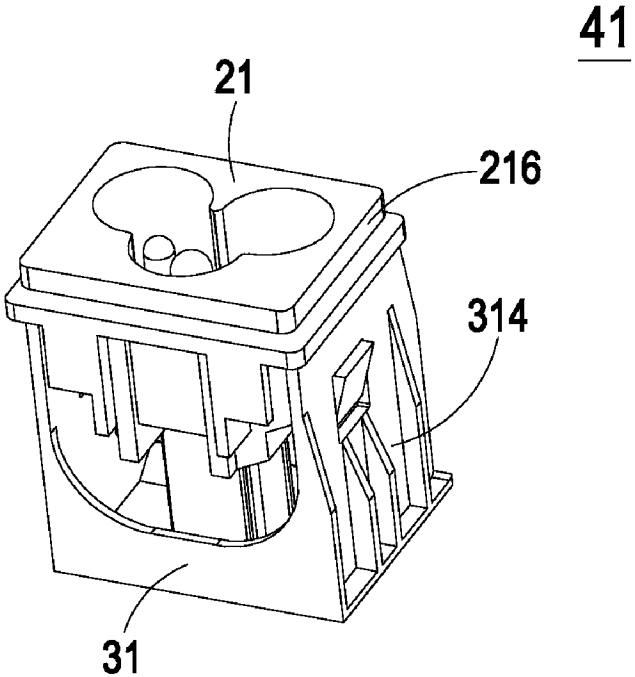
FIG. 4B shows an assembled view of a socket structure according to one embodiment of the invention.

As shown in FIGS. 4A and 4B, the exploded and assembled views of a socket structure according to one embodiment of the present invention are respectively presented. The socket structure 41 is structured by way of the combination of the socket body 21 and the holder unit 31, wherein the third connecting member 311 of the holder unit 31 is engaged with the first connecting member 214 of the socket body 21 and the forth connecting member 312 of the holder unit 31 is engaged with the second connecting member 215 of the socket body 21. In this embodiment, the first connecting member 214 and the second connecting member 215 are symmetrically disposed on the first lateral wall 218, and the third connecting member 311 and said forth connecting member 312 are symmetrically disposed on a second lateral wall 314. As shown in this embodiment, the socket body 21 further has a mating portion 216 which is configured to be mated with and fill an opening of the casing (not shown). It is to be understood that the first connecting member 214 and the second connecting member 215 of the socket body 21 are configured to be engaged with the third connecting member 311 and the forth connecting member 312 of the holder unit 31. Other techniques for engaging the first connecting member 214 with the third connecting member 311 and engaging the second connecting member 215 with the forth connecting member 312 are known in the art and may be used here. In particular, in one set of the connecting members, for example, the first connecting member 214 and the second connecting member 215 could be formed as a recess so as to be engaged with the other set, in this case, the third connecting member 311 and the forth connecting member 312 which are formed as a protrusion. As long as the required engagement could be achieved, it is also possible that the connecting members might be formed differently with each other, even though they are of the same set. In the embodiment as illustrated in FIGS. 4A and 4B, the first connecting member 214 and the second connecting member 215 are each a hook and symmetrically disposed on the first lateral wall 218 of the socket body 21 when the third connecting member 311 and the forth connecting member 312 are each a rectangular hollow and symmetrically disposed on the second lateral wall 314 of the holder unit 31.

Figure 5:
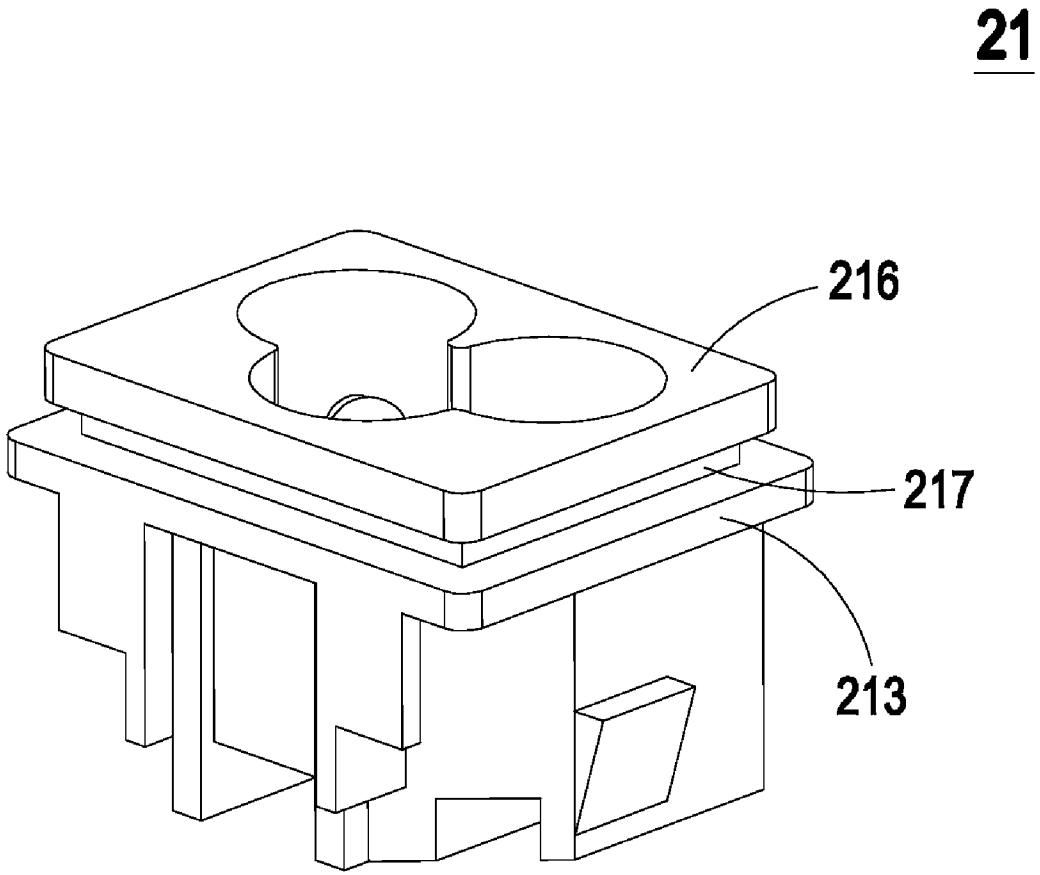
FIG. 5 illustrates a schematic of a socket body according to another embodiment of the invention.

Referring to FIG. 5, it illustrates a schematic of a socket body according to another embodiment of the invention. As shown in FIG. 5, the first end 211 of the socket body 21 has a slot 217 disposed between the mating portion 216 and the flange 213. The slot 217 is capable for being clamped by the casing adjacent to the opening (not shown in FIG. 5), and is capable of providing further securing force for securing the socket body 21 to the electronic device 1 (not shown in FIG. 5).

Figure 6:
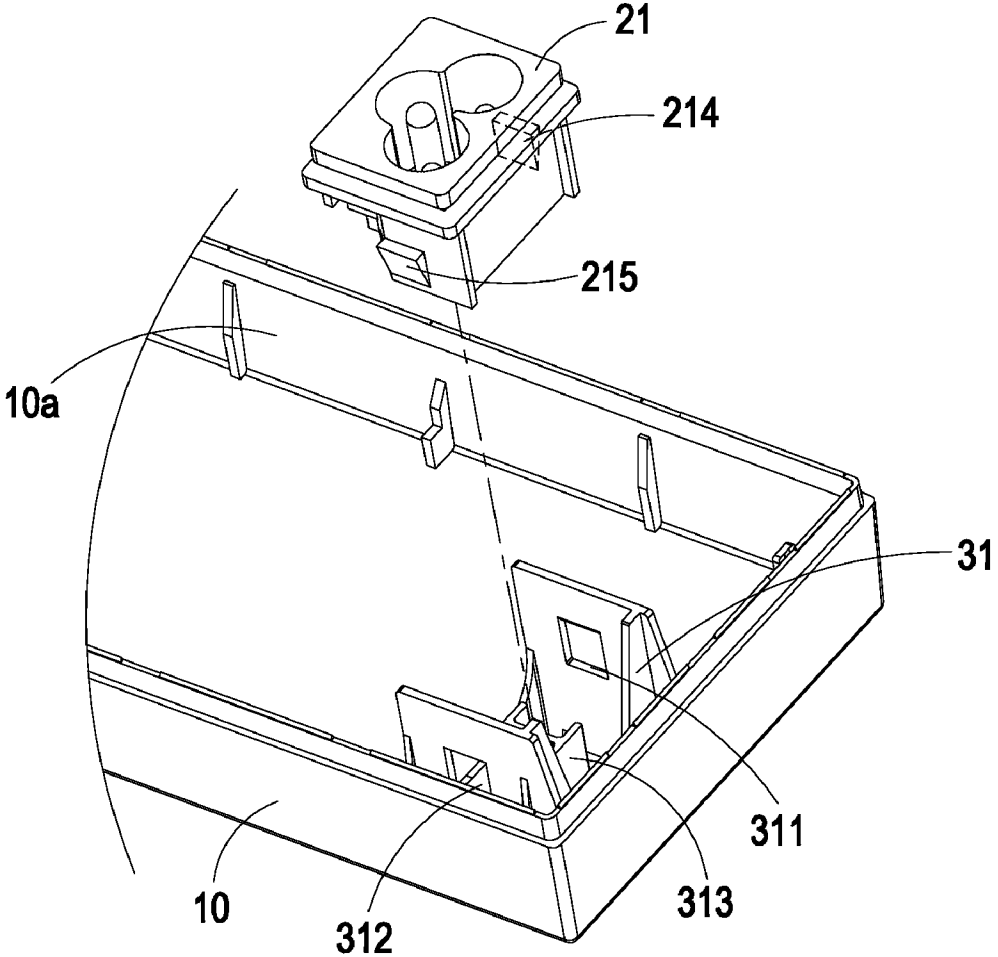
FIG. 6 is an exploded view partially showing an electronic device structure according to one embodiment of the invention.
Figure 7B:
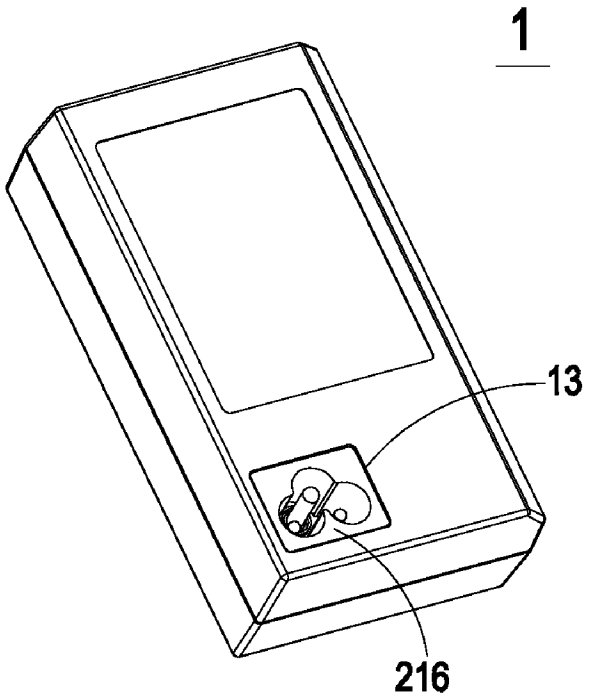
FIG. 7B shows an assembled view of an electronic device according to one embodiment of the invention.
Figure 7A:
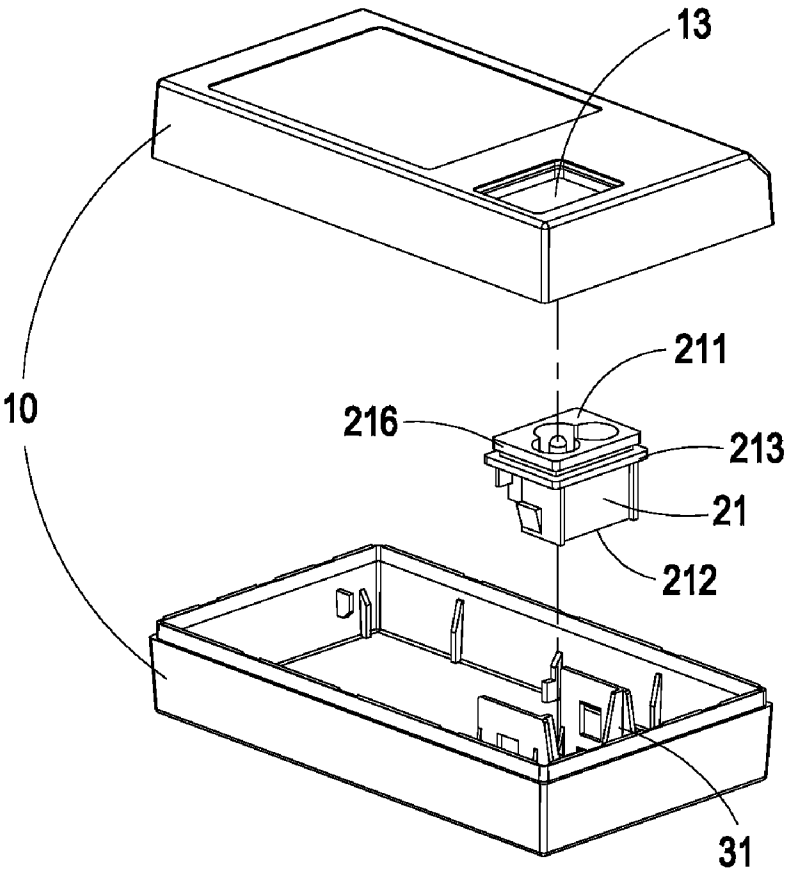
FIG. 7A shows an exploded view of an electronic device according to one embodiment of the invention.

According to one embodiment of the present invention, an electronic device comprises a casing which has an opening, an electrical circuit, a socket body and a holder unit. Referring to FIG. 6, it is an exploded view partially showing an electronic device structure according to this embodiment of the invention. As shown in FIG. 6, the socket structure 41 illustrated above is capable of being incorporated to the casing 10 inside the electronic device 1 and the bottom of the holder unit 31 is placed on an inner wall 10*a* of the casing 10 such that the socket body 21 is secured to the electronic device 1. FIGS. 7A and 7B respectively show the exploded and assembled views of the electronic device according to one embodiment of the invention. As shown in FIGS. 7A and 7B, the mating portion 216 of the first end 211 is configured to be mated with and fill the opening 13 of the casing 10. In this embodiment, for further confining the first end 211 the flange 213 is directly contacted with the inner wall 10*a* on the part adjacent to the opening 13 of the casing 10, and the slot 217 is capable of being clamped by the same. The second end 212 is capable of being coupled to the electrical circuit (not shown).

Figure 8:
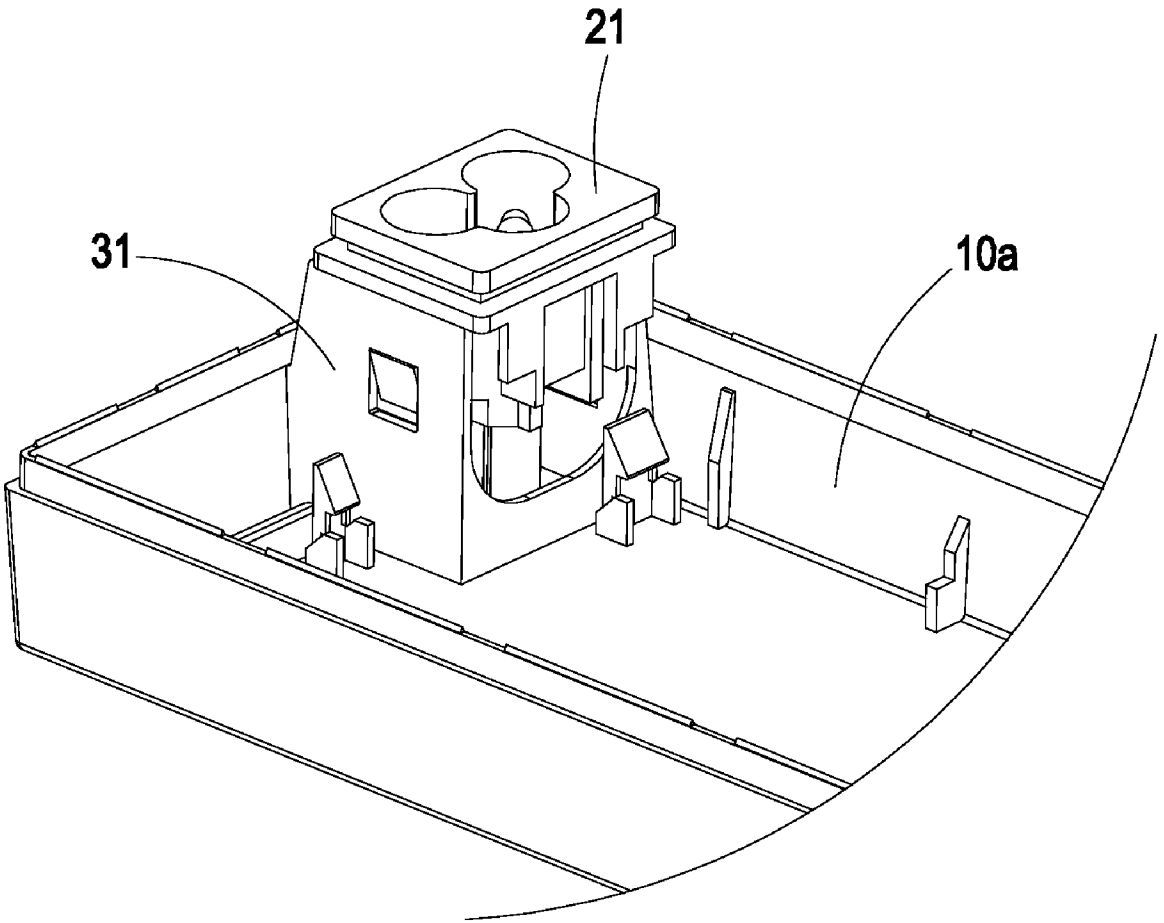
FIG. 8 is an assembled view of an electronic device according to another embodiment of the invention.

Further, FIG. 8 is an assembled view of an electronic device according to another embodiment of the invention. In this embodiment, the second lateral wall 314 is integrated with part of the inner wall 10*a* of the casing; the bottom of the holder unit 31 is integrated with part of the inner wall 10*a* of the casing 10. The integration could be accomplished by several different approaches, such as ultrasonic bonding or hot-melt adhesive etc., which are known in the art. One variation of the invention described herein would be to build a holder unit 31 with a more simple way by directly taking part of the inner wall 10*a* of the casing 10 as the second lateral wall 314 and/or taking the same to be the bottom of the holder unit 31.

From the above description, the present invention has disclosed a socket that can be firmly secured to wild variety of electronic devices, flexible in layout arrangement, and of simple construction, easily manufactured and inexpensive production.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A socket structure comprising:

a socket body comprising:

a first end having a flange extended outwardly from a first lateral wall, a second end, a first connecting member and a second connecting member, wherein said first and second connecting members respectively arranged on said first lateral wall between said flange and said second end, and said first end has a mating portion and a slot disposed between said mating portion and said flange; and a holder unit comprising a third connecting member engaged with said first connecting member and a forth connecting member engaged with said second connecting member.

2. The socket structure according to claim 1 wherein said holder unit has a protrusion member disposed on the bottom of said holder unit in order to confine said second end.

3. The socket structure according to claim 1 wherein said first connecting member and said second connecting member are each a protrusion, and said third connecting member and said forth connecting member are each a recess.

4. The socket structure according to claim 3 wherein said protrusion is a hook and said recess is a rectangular hollow.

5. The socket structure according to claim 1 wherein said first connecting member and said second connecting member are symmetrically disposed on said first lateral wall.

6. The socket structure according to claim 1 wherein said third connecting member and said forth connecting member are symmetrically disposed on a second lateral wall.

7. An electronic device comprising:

a casing comprising an opening;

an electrical circuit;

a socket body disposed in said casing, comprising:

a first end configured to be coupled to said opening, having a flange extended outwardly from a first lateral wall to overlap an inner wall adjacent to said opening inside the casing, a second end coupled to said electrical circuit, a first connecting member and a second connecting member, wherein said first and second connecting members respectively arranged on said first lateral wall between said flange and said second end; and a holder unit placed on an inner wall of said casing, comprising a third connecting member engaged with said first connecting member and a forth connecting member engaged with said second connecting member.

8. The electronic device according to claim 7 wherein said holder unit has a protrusion member disposed on the bottom of said holder unit in order to confine said second end.

9. The electronic device according to claim 7 wherein said first end has a mating portion which is mated with said opening.

10. The electronic device according to claim 9 wherein said first end has a slot disposed between said mating portion and said flange, and engaged with said casing adjacent to said opening.

11. The electronic device according to claim 7 wherein said flange is directly contacted with said inner wall adjacent to said opening inside the casing.

12. The electronic device according to claim 7 wherein said first connecting member and said second connecting member are each a protrusion, and said third connecting member and said forth connecting member are each a recess.

13. The electronic device according to claim 12 wherein said protrusion is a hook and said recess is a rectangular hollow.

14. The electronic device according to claim 7 wherein said first connecting member and said second connecting member are symmetrically disposed on said first lateral wall.

15. The electronic device according to claim 7 wherein said third connecting member and said forth connecting member are symmetrically disposed on a second lateral wall.

16. The electronic device according to claim 15 wherein said second lateral wall is one of said inner wall of said casing.

17. The electronic device according to claim 7 wherein the bottom of said holder unit is one of said inner wall of said casing.

18. The electronic device according to claim 7 wherein said electronic device is a switching power supply.

* * * * *